US005497820A

United States Patent [19]

Drake, III

[11] Patent Number: 5,497,820

[45] Date of Patent: Mar. 12, 1996

[54] BLIND TILT ACTUATOR

[75] Inventor: Frank J. Drake, III, Wausau, Wis.

[73] Assignee: Springs Window Fashions Division, Inc., Middleton, Wis.

[21] Appl. No.: 227,072

[22] Filed: Apr. 13, 1994

[51] Int. Cl.[6] ..... A47H 1/00

[52] U.S. Cl. ..... 160/107; 74/504; 160/176.1

[58] Field of Search ..... 160/107, 176.1 R; 49/64, 86.1, 87.1; 74/504

[56] References Cited

U.S. PATENT DOCUMENTS

| | | | |
|---|---|---|---|
| 3,000,263 | 9/1961 | Milton et al. | 74/504 X |
| 3,443,624 | 5/1969 | Toth | 160/107 |
| 4,274,469 | 6/1981 | Kuyper et al. | 160/107 |
| 4,369,828 | 1/1983 | Tatro | 160/107 |
| 4,427,048 | 1/1984 | Osaka et al. | 160/107 |
| 4,456,049 | 6/1984 | Vecchiarelli | 160/176 |
| 4,458,740 | 7/1984 | Anderson | 160/174 |
| 4,459,778 | 7/1984 | Ball | 49/64 |
| 4,480,674 | 11/1984 | Anderson | 160/107 |
| 4,484,611 | 11/1984 | Anderson | 160/107 |
| 4,493,357 | 1/1985 | Anderson | 160/174 |
| 4,502,523 | 3/1985 | Anderson | 160/174 |
| 4,503,900 | 3/1985 | Osaka et al. | 160/172 |
| 4,513,804 | 4/1985 | Anderson | 160/174 |
| 4,515,201 | 5/1985 | Anderson | 160/174 |
| 4,553,580 | 11/1985 | Christofferssen | 160/107 X |
| 4,687,040 | 8/1987 | Ball | 160/107 |
| 5,010,940 | 4/1991 | Marocco | 160/168 |
| 5,074,349 | 12/1991 | Yannazzone | 160/177 |
| 5,139,073 | 8/1992 | Opdahl et al. | 160/177 |

FOREIGN PATENT DOCUMENTS

| | | | |
|---|---|---|---|
| 663639 | 9/1965 | Belgium | 160/107 |
| 216625 | 10/1967 | Sweden | 160/107 |

OTHER PUBLICATIONS

"Perma Novolux Venetian blind components for 25– and 35 mm freehanging and double glazing systems," AB Perma System A Turnils Group Company, Mullsojo, Sweden (no date).

"Specification for 1000 Series (1") Metal Between Glass Venetian Blind," Window Accessory Co., Inc. Wausau, Wisconsin (no date).

"Hunter Douglas Between–Glass Blinds," HunterDouglas Architectural Products (no date).

*Primary Examiner*—Blair M. Johnson

*Attorney, Agent, or Firm*—Lathrop & Clark

[57] ABSTRACT

A venetian blind assembly has a tilt drum support with a base which has a three-segment zig-zag type slot through which two ladder legs extend and are offset sidewardly from one another, with the tilt drum interposed from front to back between the two legs. The slot holds the ladder legs apart to insure non-overlapping winding of the joined ladder legs on the tilt drum. The tilt drum is connected to a flexible cable that turns and extends vertically downwardly on the window stile. The flexible cable is positioned by a plastic guide which is fastened to the stile. The flexible cable has an extruded fitting crimped to it which has a D-shaped opening in it. The fitting receives a vertical control rod which has a D-shape. The fitting opening is substantially deeper than is required to insure a proper connection with the vertical control rod. Hence the same vertical control rod may be installed on windows that vary in height by several inches, with the excess length absorbed within the fitting opening. The lower end of the vertical control rod is engaged within a second flexible cable fitting. The second cable is supported by a lower cable guide which supports the crimped fitting to prevent vertical loads from being applied to the lower cable.

6 Claims, 5 Drawing Sheets

BLIND TILT ACTUATOR

FIELD OF THE INVENTION

The present invention relates to venetian blinds in general, and to mechanisms for causing the group pivoting of the blind slats in particular.

BACKGROUND OF THE INVENTION

Venetian blinds allow the effective control of the light admitted through a window. By adjusting the tilt orientation of the assembly of parallel blind slats sunlight glare may be blocked while still allowing sunlight or daylight to enter the room. Rotating the slab to a near vertical orientation permits the window opening to be fully obscured. Because the orientation of the slab required to achieve a desired lighting effect will vary with the time of day and the position of the sun, venetian blinds are provided with manual tilt control mechanisms which allow the quick adjustment of slat orientation.

The horizontal slab are suspended by two or more ladders formed of fabric tape or cords. Each ladder has two vertically extending legs which extend in front and in back of the slats, with flexible rungs which extend between the legs to engage the slats. The ladder legs extend into a headrail above the slats and are typically connected to a rotatable tilt drum or round tilt tube such that rotation of the drum or tube causes one ladder leg to be taken up on the drum while the other is played out from the drum or tube. The coordinated shortening of one ladder leg while the other is lengthened causes the slats, which are connected between the legs, to tilt about an axis roughly extending through the center of each slat.

Because the slats are supported on two or more ladders, it is essential that all ladders be adjusted simultaneously and to the same degree. Joint adjustment of the multiple ladders is typically achieved by a single rigid tilt rod which extends through and is fixed to both tilt drums, or by one unified tilt tube. A mechanical linkage extends from the tilt rod to a tilt actuator control, typically a knob or crank. By turning the actuator a user may set the desired degree of blind tilt.

In institutional installations where children or non-responsible persons may have access to the blind tilt controls, narrow slatted blinds are often used between panes of glass and behind window screens which are connected to the tilt rod or tube in an arrangement that allows the ladder legs to slip on the drums or tube if the tilt actuator is advanced too far. To achieve this tilt arrangement, the two legs of the ladder are typically joined in the head rail by a metal sleeve which is crimped over the separate ends of each leg to form a single loop. The plastic legs are then heat-welded together. The connected legs are looped about the drum or tube with one leg descending behind the tube and one in front. With this arrangement continued actuation of the tilt actuator after the blinds have taken on their maximum tilt in one direction will result in the harmless slipping of the looped legs on the tilt drum or tube.

The possibility exists, however, that the looped legs held on the tilt drum or tube may overlap, with one loop being elevated by an underlying loop. Particularly if the increased thickness of the sleeve is overlapped, the total length of the ladders which extend from the headrail will be reduced, with the result that all the supported slats will be raised. As the overlapping of the loops is only occasional, it is likely that one ladder may be shortened while the other remains at full length. Such a disparity will cause the entire assembly of slats to tilt sidewardly, causing an unattractive distortion to the blind appearance.

What is needed is a tilt mechanism which prevents overwinding of the ladders, yet which prevents the overlapping of the looped ladder legs.

Complete venetian blind assemblies are often supplied by the blind manufacturer to be installed in windows manufactured elsewhere. If a blind is mounted on the interior of a window the tilt rod is usually controlled by an actuator rod which hangs freely from a gearing mechanism which converts the rotation of the actuator rod about a generally vertical axis to the horizontal rotation of the tilt rod. However, blinds may be installed between a casement window and a screen, or between the two glass panes of a double pane window. In such installations the blinds are not directly accessible from the window interior. A system of flexible cables or gear boxes and rods has typically been employed to permit the tilt rod to be adjusted by the rotation of a control handle or knob which extends from the window frame interior. In conventional assemblies, one or more flexible cables permit the rotary motion of the control handle to turn comers as needed. The flexible cables are in turn connected to a rigid vertically extending rod by tiny set screws which lock a cable firing to the rigid rod. Installation of this type of cable system can present problems. The set screws required to connect the rod to the cable are extremely small and hence difficult to manipulate and require ultra-small wrenches and tools. Furthermore, because the cable and rods are unguided, the lengths of the cables and rods must be precisely matched to the size of the window opening in which they are installed. This precise length and capture of the rod by set screws is the only means of guiding the assembly. The cables and rod are under tension throughout and are thereby held in position. In addition, after installation them remains the possibility that vibration or other disturbance will cause the set screws to work loose, thereby disabling the linkage.

What is needed is a mechanical linkage between the rotating actuator handle and the tilt rod which is simple to install, has greater dimensional tolerances, and which is durable.

SUMMARY OF THE INVENTION

The venetian blind assembly of the present invention has a tilt drum or tube support with a base which has a three-segment zig-zag type slot through which the two ladder legs extend. The segments of the slot through which the ladder legs extend are offset sidewardly from one another, with the tilt drum interposed from front to back between the two legs. The zig-zag slot holds the ladder legs apart to insure non-overlapping winding of the joined ladder legs on the tilt drum.

The tilt drum has a non-round, for example, D-shaped, slot extending through it and is mounted on a D-rod which is connected to a flexible cable that turns and extends vertically downwardly on the window stile. The flexible cable is positioned by a plastic guide which is fastened to the stile. The flexible cable has an extruded malleable metal fitting crimped to it which has a D-shaped opening in it. The fitting receives a vertical control rod which has a D-shape. The fitting opening is substantially deeper than is required to insure a proper connection with the vertical control rod. Hence the same vertical control rod may be installed on windows that vary in height by several inches, with the excess length absorbed within the fitting opening. The lower end of the vertical control rod is engaged within a second flexible cable fitting. The second cable is supported by a lower cable guide which supports the crimped fitting to prevent vertical loads from being applied to the lower cable.

It is an object of the present invention to provide a tilt mechanism for a venetian blind which prevents overwinding of the ladders, while at the same time preventing the overlapping of the looped ladder legs.

It is also an object of this invention to provide a mechanical linkage between the actuator handle and the tilt rod of a venetian blind assembly which is simple to install.

It is a further object of the invention to provide a mechanical linkage between the actuator handle and the flit rod of a venetian blind assembly which may be installed on windows that vary in height by several inches with the same parts.

It is yet another object of the present invention to provide a mechanical linkage between the actuator handle and the flit rod of a venetian blind assembly which is less prone to failure after installation.

It is a still further object of the present invention to provide a mechanical linkage between the actuator handle and the flit rod of a venetian blind assembly which may be installed without the need for specialized tools.

Further objects, features and advantages of the invention will be apparent from the following detailed description when taken in conjunction with the accompanying drawings.

DESCRIPTION OF THE PREFERRED EMBODIMENT

Figure 1:
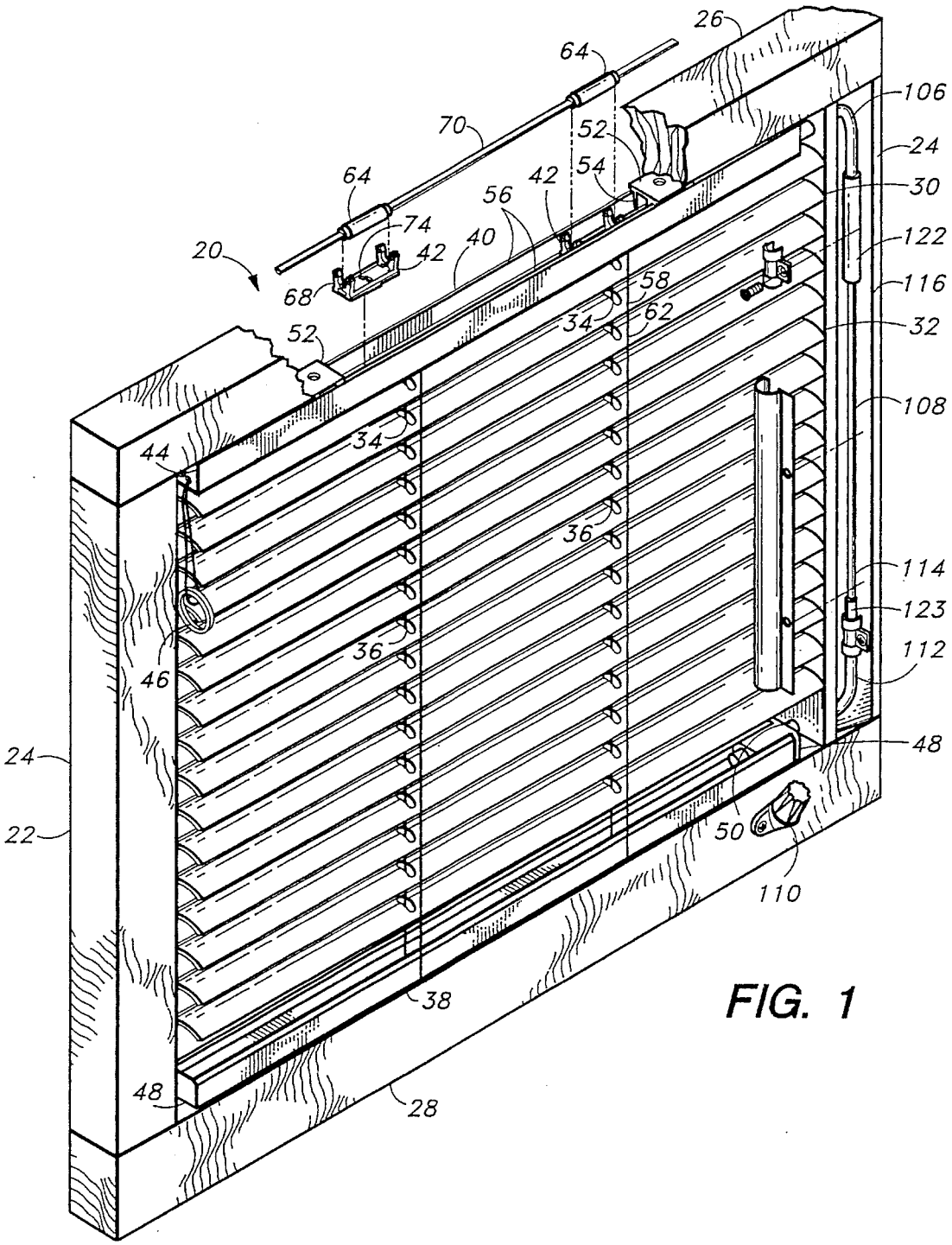
FIG. 1 is an exploded isometric view of the venetian blind tilt assembly of this invention installed within a window frame.

Referring more particularly to FIGS. 1–9, wherein like numbers refer to similar part, a venetian blind assembly 20 is shown in FIG. 1. The blind assembly is shown mounted in an exemplary window frame 22 having two vertical stiles 24 joined by a head rail 26 and a bottom rail 28. The assembly 20 would be mounted to the frame 22 in an installation between an outwardly opening casement window sash and an inward screen, although both have been omitted from the drawing for clarity. The blind assembly could also be mounted within the two panes of a double pane window sash, and would operate substantially as described for the between-sash-and-screen embodiment. Thus for purposes of this application, the term "window frame" is intended to denote either the frame which surrounds the sash or the sash itself.

The venetian blind 30 has an array of blind slats 32 which are spaced vertically one above the other. Each slat 32 has two slots 34 formed therein through which lift cords 36 extend. The lift cords 36 are connected between an extruded aluminum sillrail 38 and an extruded aluminum headrail 40. The lift cords 36 extend through plastic ladder supports 42 and out a plastic end cap 44 where the two cords are connected by a lift ring 46. The sillrail 38 has two plastic end caps 48 with protruding pins 50 which may be engaged with the frame stiles 24. The blind headrail 40 is mounted to the head rail 26 of the frame 22 by two molded plastic mounting clips 52 which have two downwardly extending tabs 54 which engage in snap-fit relation with the inwardly turned lips 56 of the aluminum headrail 40. The mounting clips 52 are fastened with screws to the wooden window head rail 26 of the frame 22. The lift cords 36 are knotted beneath the sillrail 38 and held in place by molded plastic buttons (not shown). When it is desired to raise the blind 30 for cleaning of the window pane, the lift ring 46 may be pulled downwardly and hooked to a protrusion on a stile to hold the blind slats in a compact elevated configuration.

Each blind slat 32 is supported by threads forming rungs (not shown) which extend under each slat from front to back between the front leg 58 and the rear leg 60 of a slat support ladder 62. The slab 32 are supported by two ladders which extend from the sillrail 38, where they are engaged by the same buttons which engage the lift cords 36, to the headrail 40 where they are supported on tilt drums 64 rotatably mounted to plastic ladder supports 42.

Figure 6:
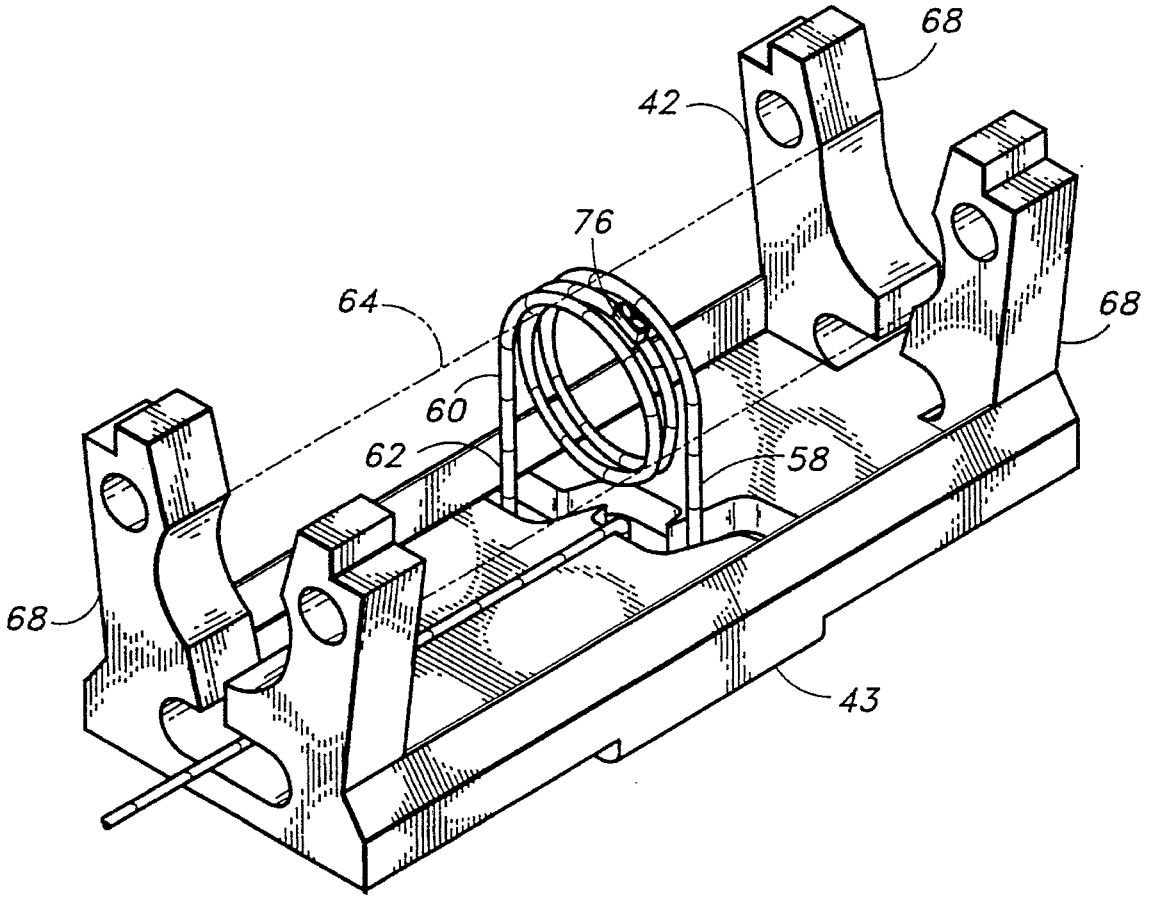
FIG. 6 is an isometric view of the ladder support of FIG. 4 with the tilt drum shown in phantom view.

Each ladder support 42, best shown in FIG. 6, has two pair of upwardly extending arms 68 which engage the plastic tilt drum 64 to prevent side-to-side displacement of the drum 64 while permitting rotational movement of the drum. The ladder support 42 has a downwardly extending protrusion 43 which engages with a rectangular hole punched in the aluminum headrail 40. A D-shaped steel tilt rod 70, shown in FIGS. 1 and 7, extends through a D-shaped opening 72, shown in FIG. 5, in the two tilt drums 64 and is rotatable to simultaneously tilt both drums 64 a like amount. As shown in FIG. 6, the ladder front leg 58 and the ladder rear leg 60 extend through a ladder slot 74 and are crimped together by a brass sleeve 76 and heat-welded together. The joined legs 58, 60 are looped about the tilt drum 64 such that rotation of the tilt drum will cause one leg to be played out from the drum while the other leg is reeled on to the drum.

Figure 2:
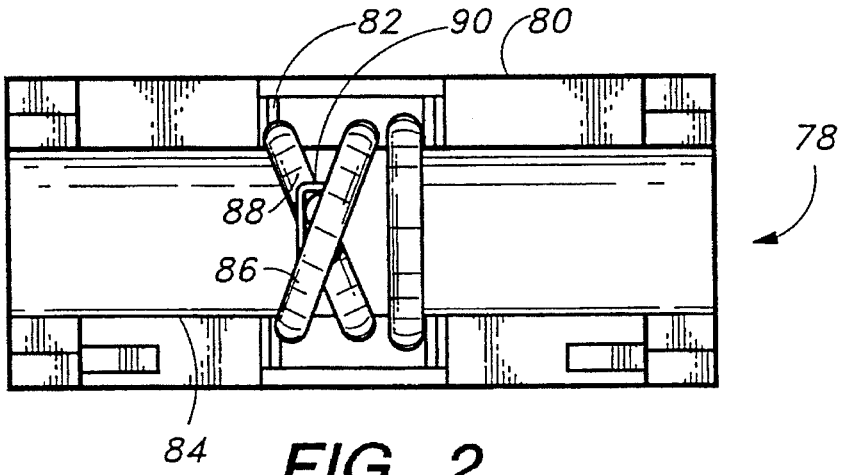
FIG. 2 (PRIOR ART)
FIG. 2 is a top plan view of a prior art ladder support in which the looped ladder legs have caused a sideward tilting of the supported blind slats.

The prior art ladder support 78, shown in FIG. 2, had a base 80 with a straight slot 82 Which extended in uninterrupted fashion from the front to the rear of the support. The straight slot 82 allowed the looped ladder legs to shift along the tilt drum 84 and occasionally resulted in one loop 86 being lifted up and elevated by an underlying loop 88. The result of this elevation was to elevate the entire ladder and hence the supported blind slats. If the overlying loop 86 should fall over the crimped sleeve 90 this distortion was particularly marked.

Figure 3:
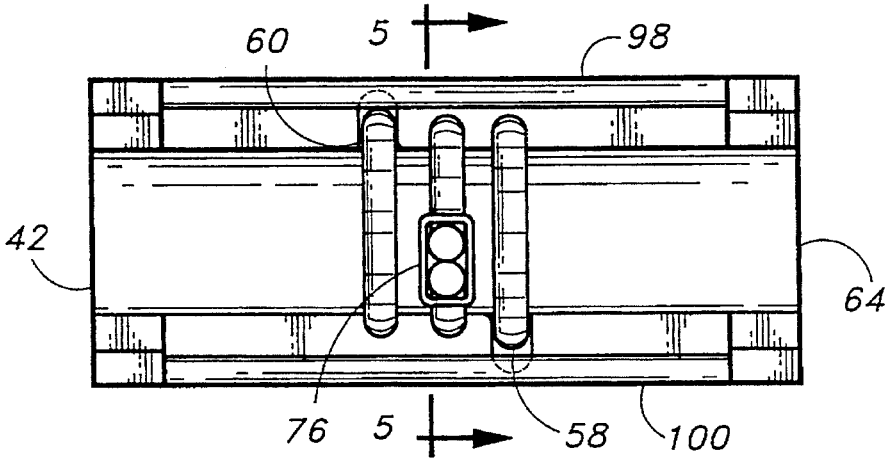
FIG. 3 is a top plan view of the ladder support of the assembly of FIG. 1.
Figure 4:
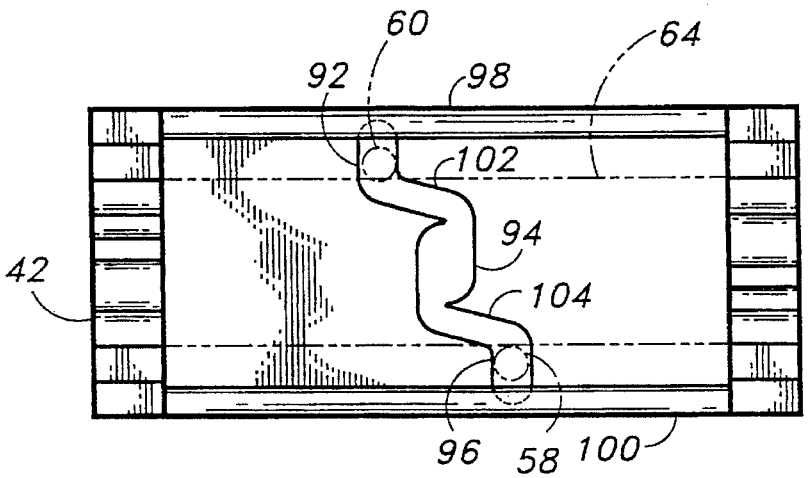
FIG. 4 is a top plan view of the ladder support of FIG. 3 with the tilt drum and ladder legs shown in phantom view.
Figure 5:
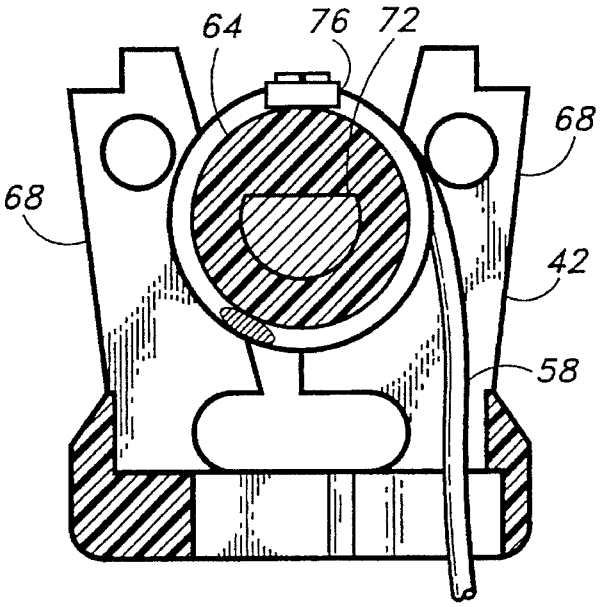
FIG. 5 is a cross-sectional view of the ladder support of FIG. 3 taken along section line 5—5.

The ladder support 42 of the present invention retains the looped ladder legs in non-overlapping condition, as shown in FIG. 3, by forming the slot 74 in a zig-zag configuration having three sidewardly spaced segments 92, 94, 96. The zig-zag slot retains each of the two legs 58, 60 spaced sidewardly from one another so that the looped ladder legs are evenly wound on the tilt drum 64. As shown in FIG. 4, the ladder support has a rear side 98 and a front side 100 which are canted inwardly a slight amount, as shown in FIG. 6. The rear leg segment 92 of the slot 74 extends frontwardly from rear side 98. The slot 74 jogs with a connecting segment 102 which is nearly perpendicular to the rear leg segment 92. The connecting segment 102 joins the slot central segment 94 which is spaced sidewardly from the rear leg segment 92. The central segment 94 of the slot 74 is wider than the rear leg segment 92 and the front leg segment 96 to permit the crimped sleeve 76 which joins the two legs 58, 60 to pass through the slot. A second connecting segment 104 extends frontwardly and sidewardly from the central segment 94 and joins the front leg segment 96, which extends substantially frontwardly.

As shown in FIG. 4, the tilt drum 64 prevents the front-to-back displacement of the ladder legs 58, 60 within the slot 74, while the rear leg segment 92 and the front leg segment 96 hold the legs from sideward displacement. With each leg 58, 60 of the ladder 42 captured by its respective slot segment 92, 96 the overlapping of the ladder legs is prevented and side-to-side even disposition of the blind slab 32 is maintained.

Figure 7:
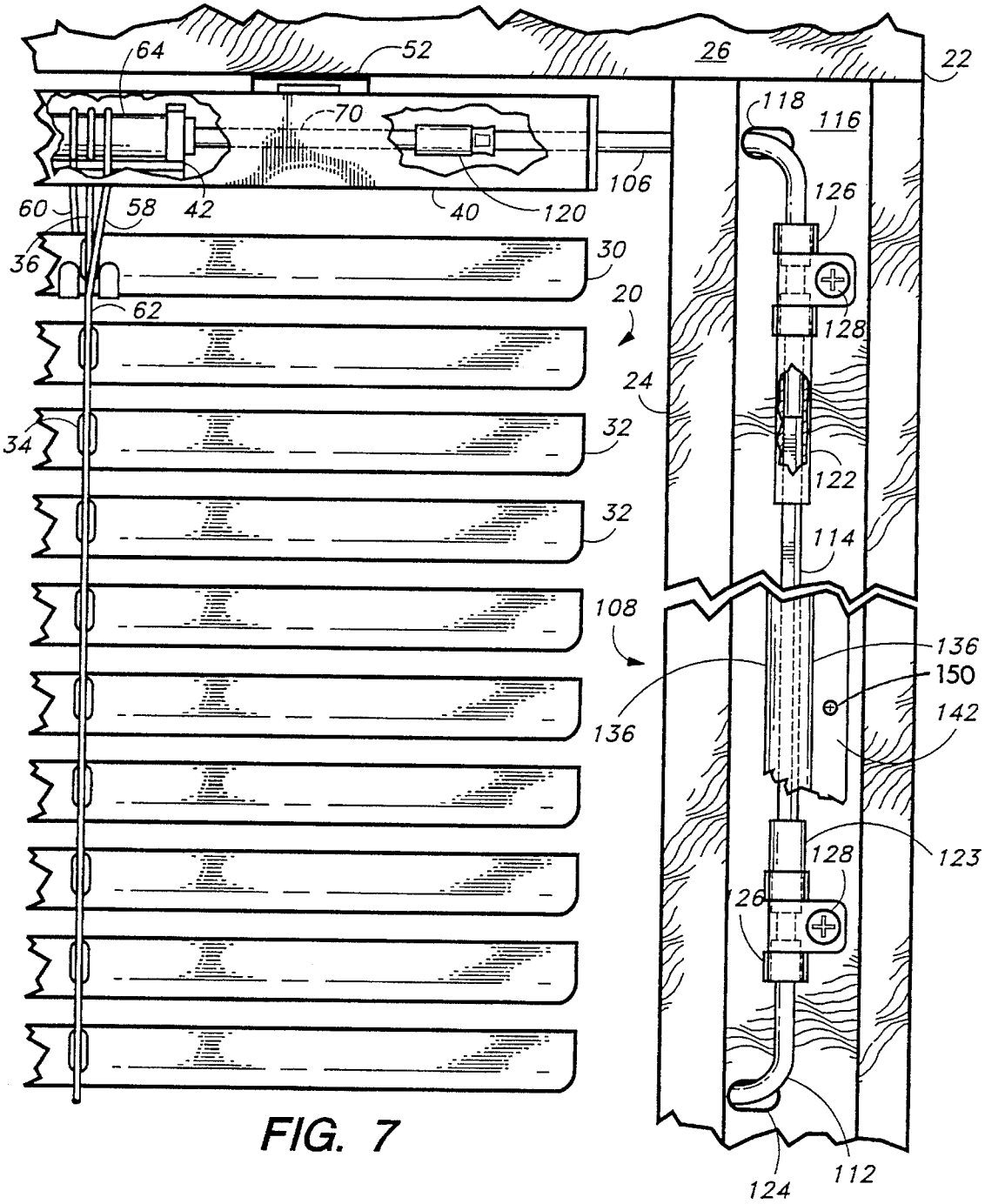
FIG. 7 is a fragmentary front elevational view of the mounted blind assembly of FIG. 1, partially broken away.

As shown in FIG. 7, the tilt rod 70 on which the tilt drums 64 are mounted is connected to a flexible cable 106 which is part of a tilt control linkage 108. The linkage 108 permits a tilt control knob or actuator 110 to be located on the frame 22 beneath the headrail 40. The linkage 108 converts the rotary motion of the actuator 110 to rotary motion of the tilt drums 64 and hence permits remote adjustment of the degree of tilt of the blind slats 32.

The venetian blind assembly 20 will typically be supplied to a manufacturer for installation in their own windows which may be custom trimmed or painted to match a customer's needs. It is thus an advantageous feature of the linkage 108 that it may be installed with minimal manipulation and without specialized tools. The linkage 108 has two flexible cables 106, 112 which are connected by a rigid D-shaped vertical control rod 114. The flexible cables 106, 112 are joined to the vertical control rod 114 in a sliding fit by two fittings with nonround, preferably D-fittings. The fittings are formed of a malleable metal such as aluminum, zinc, copper, brass, or steel, which may be crimped to the flexible cable.

The linkage 108 uses guided rods and cables which are not under tension, thus avoiding the need to maintain precise tolerances and fixed connections between the components.

The linkage 108 may be mounted along the jamb of the window stile, or it may be mounted in groove 116 formed on the exterior face of the stile 24 as shown in FIG. 7. When mounted in the groove 116, the upper flexible cable 106 passes through a hole 118 in the stile 24 to extend between the headrail 40 and the groove.

The upper flexible cable 106 has an upper D-fitting 120 which engages in a slip fit with the tilt rod 70, and a lower take-up D-fitting 122 which extends downwardly on the stile 24 to engage the vertical control rod 114. The vertical control rod 114 is connected at its lower end in a slip fitting to a D-fitting 123 which is crimped to the lower flexible cable 112. The lower flexible cable 112 extends through a hole 124 in the stile and is connected to the actuator 110 such that rotation of the actuator rotates the flexible cable 112.

Figures 8, 9:
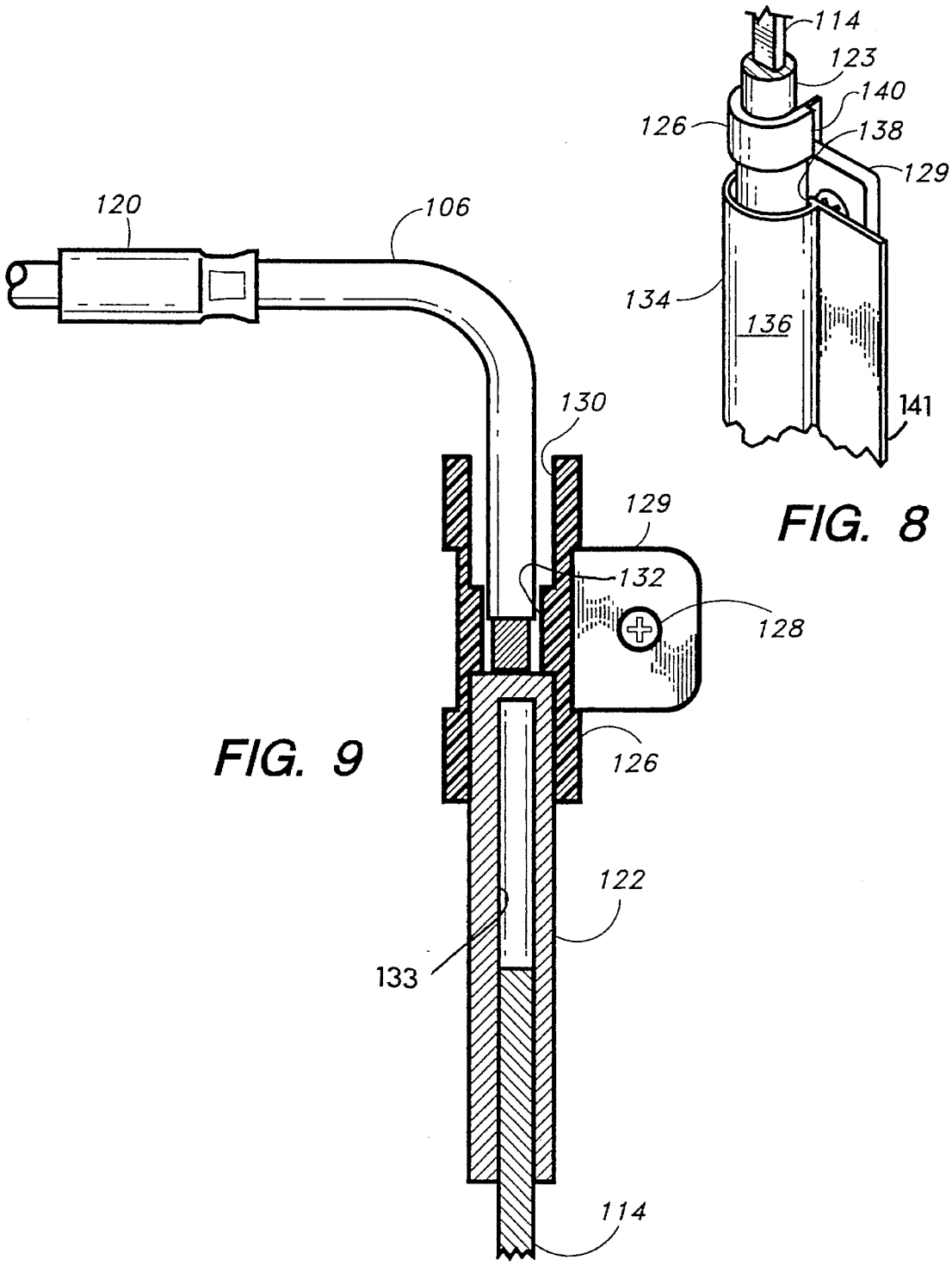
FIG. 8 is a fragmentary isometric view of a flexible cable, vertical rod connection of the tilt adjust assembly of FIG. 7.
FIG. 9 is a top plan view of a flexible cable, vertical rod connection of the assembly of FIG. 7 partially broken away in section to disclose the adjustable spacing of the connection.

The vertical spacing of the upper flexible cable 106 from the lower flexible cable 112 is set by two plastic cable guides 126, shown in FIGS.7–9. The cable guides 126 are each connected to the stile 24 by a single screw 128 which extends through a single tab 129. Each cable guide 126 has a semi-cylindrical channel 130 which prevents the sideward displacement of the flexible cable that is engaged therein. The channel 130 has a reduced diameter portion 132 in the middle of the guide 126 which is narrower than the diameter of the D-fittings 122, 123. Thus, when a flexible cable is engaged within the guide 126, as shown in FIG. 9, vertical forces on the D-rod or the D-fittings 122, 123, are transferred to the guides 126, not to the flexible cable.

As shown in FIGS. 7 and 9, the slip fit between the vertical control rod 114 and the take-up D-fitting 122 allows the same linkage assembly 108 to be used on windows of different vertical dimension, and also allows more leeway in installation of the linkage. The D-fitting 122 has a D-shaped opening 133, shown in FIG. 9, which opens downwardly and receives a portion of the vertical control rod 114. The opening 133 is substantially longer than the length of rod required to be engaged to obtain an acceptable connection. For example, where the engagement of one inch of vertical control rod would be acceptable, the opening 133 may be three inches long. To provide a one-inch tolerance for positioning of the components of the linkage assembly 108, the vertical control rod 114 will be cut to provide two inches of engagement with the take-up D-fitting 122. If the guides 126 are placed an inch too close together, three inches of control rod will be engaged in the take-up D-fitting, if the guides are placed an inch too far apart, one inch of control rod will be engaged.

Not only does the slip-fit connection between the vertical control rod and the flexible cables permit greater tolerances in assembly, it eliminates the need to make any screw connections between the cables and the control rod. Manipulation of small set screws in cable fittings is difficult, and the screws are particularly likely to be lost due to their small size. By eliminating the tiny set screws, installation of the assembly 20 is possible without specialized tools. The slip-fit connection also provides better durability of the installed linkage assembly 108. Because there are no set screws, there is no possibility that the connection between the control rod and the cables will become loosened with vibration or expansion. The larger size screws 128 hold the guides 126 in place, and as long as the cable guides are properly positioned, the control rod and cables will be operably connected.

As shown in FIG. 8, a plastic cable cover 134 engages with the cable guides 126 in a snap fit. The cover 134 has a semicircular shield 136 which snaps over guide 126 and has inwardly extending tabs 138 which engage behind outwardly extending protrusions 140 on the guides 126. The cover 134 has a side flange 141 which obscures the cable guide tabs 129. As shown in FIG. 1, the cover 134 is screwed in place by at least one fastener 150 and protects the linkage assembly 108 from exposure and also visually obscures the linkage assembly.

It should be noted that the linkage assembly may employ only a single flexible cable. Alternatively, the upper flexible cable may be replaced with a geared linkage arrangement. Furthermore, although the fittings and vertical control rod have been disclosed as having a "D" cross-section, other non-cylindrical shapes which allow the keying of the control rod to the flexible cable fittings may be employed.

It should also be noted that although a rotatable drum mounted on a rod has been illustrated as the roll on which the ladder is wound, the function of the roll can equally be performed by a single continuous cylindrical rod which is engaged by the ladder supports.

It is understood that the invention is not limited to the particular embodiments disclosed and illustrated herein, but embraces such modified forms thereof as come within the scope of the following claims.

I claim:

1. A tilt assembly for the tilt adjustment of a venetian blind within a window frame, the assembly comprising:

a) a rotatable actuator;

b) a first flexible cable engaged with the actuator to be rotated thereby, wherein the first flexible cable extends upwardly from the actuator;

c) a rigid rod which is engaged with the first flexible cable to be rotated thereby and which extends substantially vertically upwardly from the first flexible cable, wherein the rod has upwardly extending noncylindrical portions;

d) a second flexible cable which is connected for adjusting the tilt of blinds, wherein the second flexible cable has a downwardly extending fitting connected thereto, the fitting having a generally cylindrical exterior, wherein the fitting has portions defining a noncylindrical cavity which receives the noncylindrical portions of the rigid rod, the rod thereby connecting the first flexible cable to the second flexible cable such that rotation of the actuator causes the rotation of the second flexible cable, and wherein the fitting cavity is of sufficient depth to permit engagement of the rigid rod over a range of rod heights or positioning of the rod; and e) at least one cable guide which attaches to a vertical stile of a window frame, the cable guide having portions which define a generally vertical channel, and wherein the second flexible cable fitting is engaged within the cable guide channel and thereby restrained from side to side movement.

2. The tilt assembly of claim 1 wherein the guide channel has a first portion which is wide enough to allow rotation of the cable fitting therein, and an abutting narrow portion through which the second flexible cable extends, wherein the narrow portion is narrower than said fitting cylindrical exterior to prevent transmission of vertical displacement from the rod to the second cable.

3. The tilt assembly of claim 1 further comprising:

a) portions of the cable guide which define protrusions which extend outwardly; and b) a plastic cover which covers the rod and which has a plurality of inwardly extending tabs which engage with the cable guide protrusions to hold the cover in place.

4. The apparatus of claim 1 further comprising:

a) an upper cable guide which is fixed to the window frame and which engages with the second flexible cable and retains the downwardly extending fitting with respect to the window; and b) a lower cable guide which is fixed to the window frame and which engages the first flexible cable.

5. A window and blind assembly comprising:

a) a window having a frame with a vertical stile;

b) a venetian blind positioned for shading of the window;

c) a rotatable actuator mounted to the frame;

d) a first flexible cable engaged with the actuator to be rotated thereby, wherein the first flexible cable extends upwardly from the actuator;

e) a rigid rod which is engaged with the first flexible cable to be rotated thereby and which extends substantially vertically upwardly from the first flexible cable along said window stile, wherein the rod has upwardly extending noncylindrical portions; and f) a second flexible cable which is connected to the venetian blind for adjusting the tilt thereof, wherein the second flexible cable has a downwardly extending fitting connected thereto, wherein the fitting has portions defining a noncylindrical cavity which receives the noncylindrical portions of the rigid rod, the rod thereby connecting the first flexible cable to the second flexible cable such that rotation of the actuator causes the rotation of the second flexible cable, and wherein the fitting cavity is of sufficient depth to permit engagement of the rigid rod over a range of rod heights or positioning of the rod; and g) means for spacing the first flexible cable from the second cable, wherein the means for spacing is fixed to said window stile, and wherein the means for spacing positions said second flexible cable with respect to said first flexible cable to retain the rigid rod in engagement with the first and second cables, and wherein said means for spacing includes means for blocking transmission of vertical forces from said rod to said flexible cable.

6. A tilt assembly for the tilt adjustment of a venetian blind within a window frame, the assembly comprising:

a) a rotatable actuator;

b) a first flexible cable engaged with the actuator to be rotated thereby, wherein the first flexible cable extends upwardly from the actuator;

c) a rigid rod which is engaged with the first flexible cable to be rotated thereby and which extends substantially vertically upwardly from the first flexible cable, wherein the rod has upwardly extending noncylindrical portions;

d) a second flexible cable which is connected for adjusting the tilt of blinds, wherein the second flexible cable has a downwardly extending fitting connected thereto, wherein the fitting has portions defining a noncylindrical cavity which receives the noncylindrical portions of the rigid rod, the rod thereby connecting the first flexible cable to the second flexible cable such that rotation of the actuator causes the rotation of the second flexible cable, and wherein the fitting cavity is of sufficient depth to permit engagement of the rigid rod over a range of rod heights or positioning of the rod; and e) at least one cable guide portion associated with the vertical stile of a window frame, the cable guide portion having portions which define a generally vertical channel, and wherein the second flexible cable fitting is engaged within the cable guide channel and thereby restrained from side to side movement.

* * * * *